United States Patent [19]

Gale

[11] 3,952,523

[45] Apr. 27, 1976

[54] METHOD OF INSTALLING A SCREW-TYPE ANCHOR

[76] Inventor: Jack D. Gale, Rte. 1, Crowley Road, Crowley, Tex. 76036

[22] Filed: July 28, 1975

[21] Appl. No.: 599,764

Related U.S. Application Data

[62] Division of Ser. No. 435,224, Jan. 21, 1974, Pat. No. 3,896,890.

[52] U.S. Cl. ..... 61/39; 52/157; 61/53; 173/23; 175/19

[51] Int. Cl.[2] ..... E02D 5/80

[58] Field of Search ..... 61/39, 35, 63; 175/19, 175/20, 323, 325, 320; 52/157, 165; 73/84, 85, 146, 145

[56] References Cited

UNITED STATES PATENTS

| | | | |
|---|---|---|---|
| 1,193,725 | 8/1916 | Smith | 52/165 X |
| 1,849,268 | 3/1932 | Birkenmaier | 52/157 |
| 1,940,938 | 12/1933 | Chance | 52/165 X |
| 3,148,739 | 9/1964 | Mattingly et al. | 173/145 X |
| 3,293,809 | 12/1966 | Daline | 52/157 |
| 3,363,422 | 1/1968 | Turzillo | 61/39 X |
| 3,830,315 | 8/1974 | Love | 52/157 X |

*Primary Examiner*—Dennis L. Taylor
*Attorney, Agent, or Firm*—Charles W. McHugh

[57] ABSTRACT

The method of securely placing a screw-type anchor in the earth without unduly disturbing the surrounding soil, including the step of enveloping the anchor's shank in a special tubular mandrel. The mandrel has a helical flight near its bottom end, with a pitch that is substantially the same as the anchor's flight, such that the mandrel's flight constitutes an effective extension of the anchor's flight. When the anchor/mandrel combination is rotated in a first direction, the two elements will burrow as a unit into the ground. After the mandrel has been rotated sufficiently to put the anchor at a designed depth in the earth, rotating the mandrel in the opposite direction causes it to separate from the anchor and back out of the earth through substantially the same cut that was made when the anchor was turned into the earth. A preferred manner of applying torque to the mandrel is to utilize an electrically powered portable torque unit, in which the direction of rotation (clockwise or counterclockwise) is selectable by manually flipping a switch. Torque reaction loads from the portable torque unit are preferably passed to the earth through a mobile frame which is rolled to the installation site on wheels or the like.

4 Claims, 13 Drawing Figures

METHOD OF INSTALLING A SCREW-TYPE ANCHOR

This is a division of Ser. No. 435,224 filed Jan. 21, 1974, now U.S. Pat. No. 3,896,890.

This invention relates to anchoring things to the earth without first digging a hole. It relates in general to anchors adapted to be inserted into the earth, and more particularly it relates to a screw-type anchor and a means for installing the same in the earth by rotating it and not unduly disturbing the surrounding soil.

There are many occasions when it is desirable to provide an anchor in the earth with one end protruding above the soil, to which can be secured ropes, guy lines, straps and the like. A very common use for such anchors is in securing the ends of straps and cables with which to hold mobile homes securely to the earth (when they are not being moved). Exemplary of such anchors are those shown in U.S. Pat. No. 3,747,288 to Grimelii entitled "Double Anchorage Clamp". Because the shank or post of such anchors may be relatively long, applying torsional loads to the top end of a shank, while the flight on the other end is being turned into the earth, frequently leads to torsional failure of the shank. In order to avoid such torsional failure during installation, it has been common to employ a tubular mandrel which envelopes the shank and applies torsional loads to the anchor near the flight thereof. Exemplary of such a tubular mandrel or sleeve is the device shown in U.S. Pat. No. 3,148,510 to Sullivan entitled "Method of Installing Earth Anchors". The Sullivan sleeve and other commercial variations of such devices have a particular liability, however, in that they must be physically removed from a hole after the anchor has been embedded in the earth. Such removal has normally been accomplished by manually grabbing the top end of the mandrel and swinging the same backward and forward, while at the same time exerting a general lifting force, until the mandrel has been extracted. Some other techniques have included the use of winches to pull directly upward on the mandrel, either with or without a manual rocking or swinging movement to dislodge it. Unfortunately, the prior process of removing a mandrel frequently undermined the very purpose of installing an earth anchor; that is, it tended to pulverize at least some dirt and caused a deterioration in the integrity of the soil. It was also very time consuming, as well as being a non-constructive task. Accordingly, it is an object of the present invention to provide a means for installing earth anchors which does not unduly disturb the surrounding soil.

Another object is to provide a method for the powered removal of a mandrel as well as the powered insertion of a mandrel and an associated anchor.

Still another object is to provide a device which can be used by a single person to readily install screw-type anchors in the earth.

One more object is to provide a machine which can easily install anchors under mobile homes which are already placed on site, with the top end of the anchor being located within the periphery of the mobile home, such that skirting and the like can effectively conceal the installed anchor head.

These and other objects will be apparent from a reading of the specification and the claims appended thereto, as well as the attached drawings.

Figure 12:
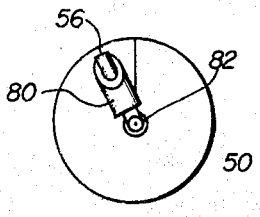
FIG. 12 is a bottom view of a means for mating a separable flight to an anchor bolt.
Figure 13:
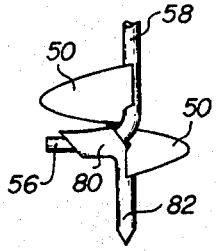

And FIG. 13 is an elevation view of the device shown in FIG. 12, and additionally showing a short spike to foster entrance of the flight into the ground.

Figure 1:
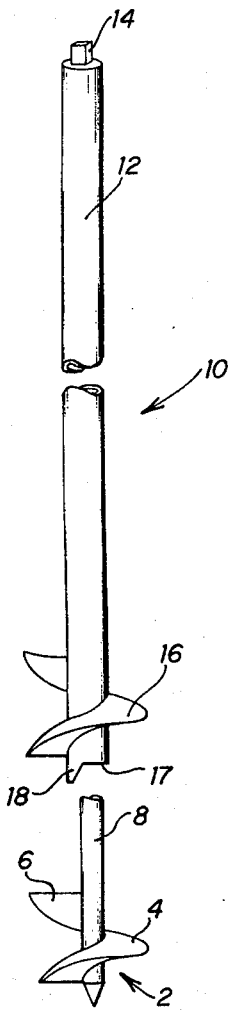
FIG. 1 is an elevation view showing a tubular mandrel of the invention, including the attached flight that permits the mandrel to be rotated out of the earth after installation of an anchor.

Referring initially to FIG. 1, an installation tool 10 made in accordance with the invention includes a substantially tubular body 12 having at its top end an angular head 14 to which torsional loads may be readily applied. Such torsional loads may be provided from any of a variety of commercially available torque units, including, for example, the Ridgid Model 700 portable power drive manufactured by The Ridge Tool Co. of Elyria, Ohio. Similar products which are primarily sold as drive units for pipe cutting, reaming or threading are sold by Collins, Rockwell, Hanes, etc. Regardless of the manufacturer, it is desirable that the unit be reversible, i.e., that it provides torque in both a clockwise and counterclockwise direction. A typical configuration for the angular head 14 is that of a square, with sides about one inch to two inches in length. At the bottom end of the illustrated installation device 10 is a flight 16. Before describing in detail the preferred pitch, size, and location of the flight 16, it is perhaps appropriate that a typical anchor be described, such that a reference point for a description of a flight of the invention may be obtained.

A fairly common anchor is illustrated in the U.S. Pat. to Sullivan No. 3,148,510, wherein a shank or rod is provided at its opposite ends with a flight and a threaded head (to which a rope or the like is subsequently attached). It has been common to manufacture the flights by taking a metal disc of a desired outer diameter, cutting a small hole in the center to accommodate the shank, and then making a single radial cut from the hole outward to the periphery of the disc. The disc is then bent such that the two ends (which were created when the radial cut was made) are then widely separated. The disc is then slid over one end of the shank and welded thereto. A flight made from such a round piece of sheet metal is frequently called a spoon; perhaps one reason for such a description is that such flights tend to churn and lift the soil as they are rotated into the earth. In contrast to such commonly used "spoons", a preferred flight of this device is a helical flight. The term "helical", of course, refers to a curve such as would be obtained by winding a thread around cylinder in such a manner that there would be a uniform amount of advance with each revolution. In contrast to "spoons", helical flights will cut through the ground during insertion but will not unduly disturb or significantly remove dirt from the hole.

Helical flights for earth anchors can be made in much the same way that helical conveyor stock is prepared, and conventional machinery can be used. Conventional helical conveyor stock is formed from long and relatively narrow strips or skelp. The skelp size is selected in accordance with the desired outer diameter of the flight, as well as the diameter of the shank to which the flight will be attached. For an exemplary anchor which might be installed for anchoring mobile homes, skelp having a thickness of one-quarter inch and a width of two and one-half inches is passed through a set of serially arranged dies, which twist or turn the long strip until it forms the desired helix. The formed helix will normally still have its one-quarter inch thickness on its inner side, but it will be thinned to about one-eight inch or less on its outer side; this is particularly beneficial in that it effectively forms a sharpened blade for cutting through the soil. The relatively long piece of helical stock is then cut into small sections of about one full turn and placed on one end of a shank and secured thereto, such as by welding. As the helical stock is being progressively welded to the shank, it is positioned so that a pitch of about two and one-half inches is obtained- in a preferred embodiment. In order that the flight will cut easily into the ground, it is also preferred that the flight include at least a full turn (i.e., a 360° span), and a span of approximately 400° has been found to be quite satisfactory. A greater length can, of course, be used; and a long section of flight will no doubt provide more structural reliability, because there can be a longer weld bead on a longer flight. But it should be remembered that the purpose of the anchor is to hold some strap or rope securely to the earth; and, preferably, it should be able to do this immediately after installation-not some 6 months or so later after some loose fill dirt has been poured back into an oversize hole and allowed to "settle". Too, the true purpose of a torque tube 10 should be to put an anchor flight (base) as deeply as seems necessary in the earth without unduly disturbing (and therefore diminishing the holding power of) the earth. Hence, the torque tube 10 should not be confused with an auger which would be used to loosen and remove dirt from a hole. If it had been desired that the tube 10 serve as an auger, naturally it would be necessary that the flight 16 extend for the full length of the tube, so that soil which is torn loose at the bottom of a hole would be subsequently pushed upward to the surface.

Referring now to other details of the flight 16 which is affixed to the torque tube 10, the pitch of the flight is preferably the same as the pitch of the flight 4 on an anchor 2. Also, the beginning (i.e., the bottom edge) of the flight 16 is preferably set so that it coincides with the termination (top edge) 6 of the flight 4 on the anchor, so that the flight 16 will easily follow behind the anchor flight as the two elements rotate downward through soil. That is, the tubular flight 16 forms an effective extension of the anchor flight 4 when the two are being rotatably driven into the earth. The outer diameter of the flight 16 preferably should be no larger than the size of the anchor flight, and it can be quite a bit smaller. If the diameter of the flight is made too small, however, its length may have to be increased in order to achieve the same lifting power as it is rotated. Indeed, it is the ability of the flight 16 (upon being rotated) to lift the mandrel 10 and the powered drive unit resting on top of the mandrel (usually weighing about 25 lbs.) that dictates the overall size of the flight. A relatively short, wide flight 16 as illustrated in FIG. 1 is quite adequate for its purpose; but a relatively long, narrow flight could logically serve as well.

Another element which is advantageously placed on the installation device 10 is a protuberance 18 which extends axially downward at the bottom end of the device and engages the anchor 2 near its flight 4, so that torsion forces which are applied to the tube will in turn cause the anchor to be turned in a direction so that it may be screwed into the ground. It is not necessary that the protuberance 18 be locked to the anchor 2; rather, it is quite adequate for the protuberance to simply engage (i.e., bear against) the anchor when it is turned in a "burrowing" direction. A common method of manufacturing the tubular device 10 is to have the protuberance 18 constitute an integral part of the tubular body 12, extending downwardly for approximately one inch or so below the bottom end 17 of the tubular body; in such a case, the protuberance 18 will readily bear against the upper edge 6 of an anchor flight. If manufacturing tolerances are held very close, the protuberance 18 could possibly be omitted in favor of simply employing the lower edge of the flight 16 as a means for bearing against the upper edge 6 of the anchor flight, whereby turning the tubular body 12 will inherently turn the anchor flight 4. It will be seen, then, that provision of the proturberance 18 insures that the two units can be rotated together into the ground, without necessarily relying on edge-to-edge contact between the adjacent flights 4, 16.

In operation of the device, the tubular body 12 is manually placed over the shank 8 of an anchor 2, until the protuberance 18 engages the anchor flight 4. The tip of the anchor 2 is then placed in contact with the earth, with the anchor being in a generally upright position. A powered torque unit is then engaged with the angular head 14, and activated so as to rotate the tubular body 12 in a direction to drive the anchor 2 into the ground. By employing the tubular mandrel 12, torsional loads are transferred from the drive unit to the anchor near the anchor's flight 4, such that the anchor shank 8 does not experience any torsional loading (above the flight). After the anchor 2 has been rotated sufficiently to achieve a desired depth in the earth, the powered unit is reversed in its direction of rotation, such that the mandrel is rotated in an opposite direction. During descent of the anchor, the anchor 2 and tubular mandrel 10 were held together only by virtue of the protuberance 18, and reversing the direction of rotation causes protuberance 18 to back away from the anchor flight 4. As the mandrel 10 rotates in said opposite direction, the flight 16 causes the mandrel to be lifted such that very quickly the only contact between the two is perhaps the rotating tube 12 rubbing against the static shank 8 held therein. (At this point it is perhaps appropriate to mention that the term "mandrel" is used herein in the sense of a work-holding or work-driving element, even though it is recognized that most other mandrels are usually thought of as being solid.) With continued rotation, the mandrel 10 is lifted out of the earth through substantially the same cut that was made when the anchor 2 was turned into the earth. Thus, the mandrel 10 is readily removed from the earth without further disturbing the surrounding soil, and the anchor 2 is securely held at its terminal depth-immediately and without the need for any subsequent compacting, etc.

Having thoroughly described the operation of the flight 16, it should now be more apparent how certain trade-offs in design might be made without departing from the spirit of the invention. Thus, it should be seen how a relatively thin flight (constituting almost a narrow ridge) could be placed along a helical path for an appreciable length of the tubular body 12, in lieu of a short but wide flight. The only object is to easily lift the mandrel out of its hole by rotating the same, and it matters not whether the lifting (or pushing) force is achieved from a short helix having a relatively large diameter or a long helix having a relatively small diameter.

Figure 7:
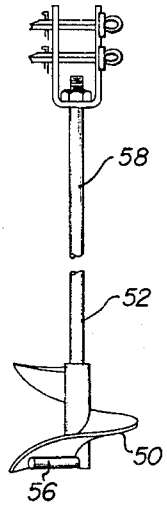
FIG. 7 is a front elevation view of an anchor which can be installed with the apparatus.
Figure 8:
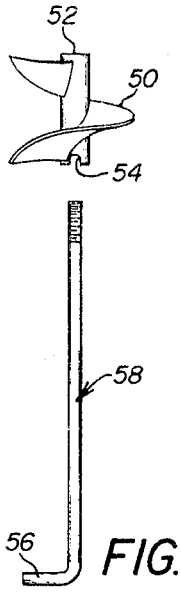
FIG. 8 is a view of the anchor shown in FIG. 7, prior to assembly.
Figure 9:
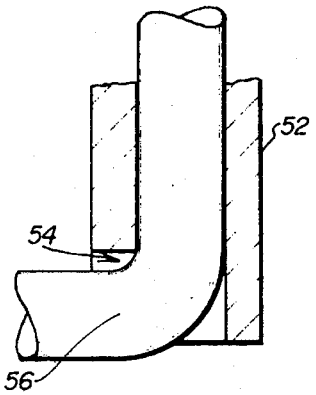
FIG. 9 is a partial, enlarged view of the base of the anchor bolt shown in FIG. 7.

It will be recalled the prior art anchors have been described as having a shank and a welded flight at the bottom end thereof. In contrast to such prior art anchors, the anchor usable with this invention has been more broadly described as one where the flight is "secured" to the bottom end of a shank. The term "secured" has been used for the reason that it encompasses (besides welding) a mechanical connection including threads and/or interlocking pieces. In another embodiment of the invention shown in FIGS. 7–9, the flight 50 is provided with a central collar 52 or the like having a recess 54 into which an L-shaped foot 56 on an anchor bolt 58 may be engaged. In installation of such an anchor, the flight 50 would be inserted over the elongated shank of a L-shaped anchor 58, and the flight would be slid to the bottom where the recess 54 would engage the short leg of the L-shaped bolt, as shown in FIG. 9. In order that the foot 56 will not unduly interfere with downward rotation of an anchor, it is preferred that the recess 54 in the bottom end of the collar 52 be located so that the foot will nest immediately next to the bottom surface of a flight 50, as shown in FIG. 7. A mandrel would then be placed over the shank and a protuberance or the like on the mandrel would engage the top portion of the flight (or its central collar), in much the same manner as described above. The weight of the tubular mandrel as it sits on the collar 52 will keep the collar and the front 56 mechanically engaged, so no welding is really necessary. A principal advantage of a construction of this embodiment is it permits an L-shaped shank of any desired length to be combined at will with a special flight 50, so that a person might have shanks of 2 feet, 4 feet, 8 feet, etc., available for his use-depending on the kind of soil he encounters when he arrives at a job site.

With the helical flight 16 affixed to a tubular mandrel 10, it has been found that approximately 50 percent of the traditional installation time of a mobile-home anchor can be saved-compared to prior art techniques. That is, it had frequently been necessary to spend as much time removing a torque tube from a hole as it took to put an anchor in the hole. With the present mandrel, the time to rotate the mandrel out of a hole four feet deep is usually less than one minute, and no manual labor is being expended since the drive unit accomplishes all of the required work. Most torque units will turn at a speed of about 16 RPM, so the time to remove a mandrel from a given depth can be readily calculated, once the pitch of the flight 16 is known.

Figure 3:
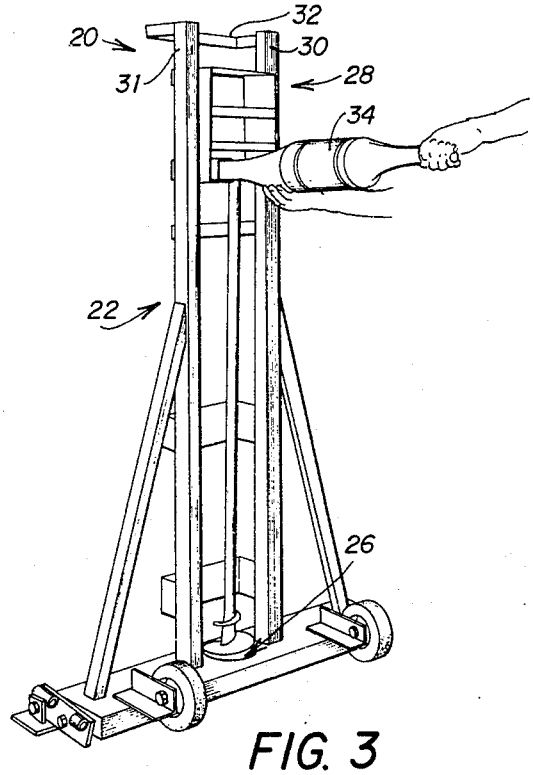
FIG. 3 is a perspective view of the apparatus as shown in FIG. 2, with a mandrel and a power unit shown in operative positions.
Figure 2:
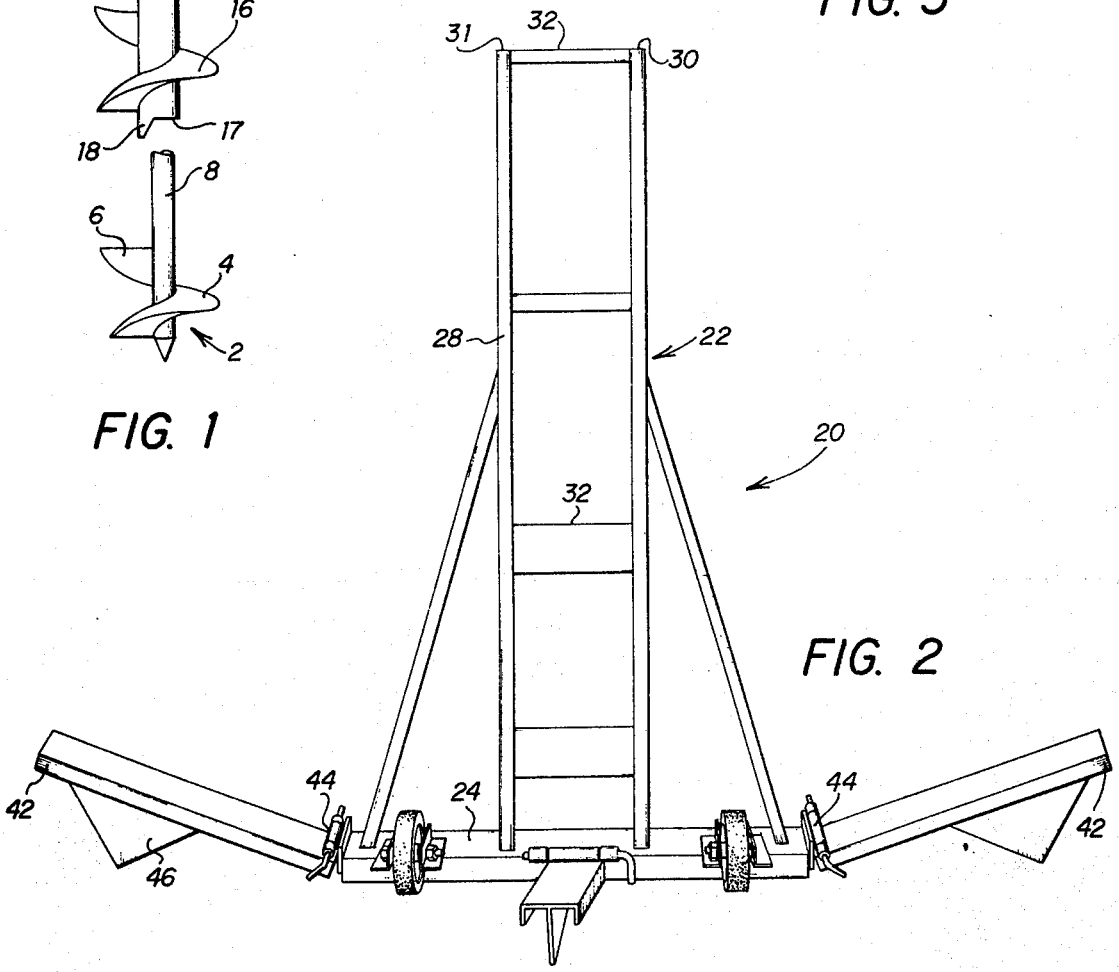
FIG. 2 is a front elevation view of a mobile structure which is particularly useful for resisting the torque loads which occur during installation of an anchor.

Having described the structure and operation of the tubular mandrel 10, an apparatus which is particularly useful in handling such devices will now be described. The apparatus 20 includes a supporting structure 22 having a base 24 with an opening 26 adapted to surround the area through which an anchor is to be turned so as to drive the same into the earth. (A front elevation view of the apparatus is shown in FIG. 2, and a perspective view is shown in FIG. 3.) The supporting structure 22 also includes an upright frame 28 which extends above the opening 26. The frame 28 is formed by two opposed channels 30, 31 rigidly braced by cross members 32. The lengths of the cross members 32 are established such that the distance between the opposed channels 30, 31 is slightly larger than the width of a powered unit 34 which is to be used to provide torque for driving an anchor into the ground.

Figure 4:
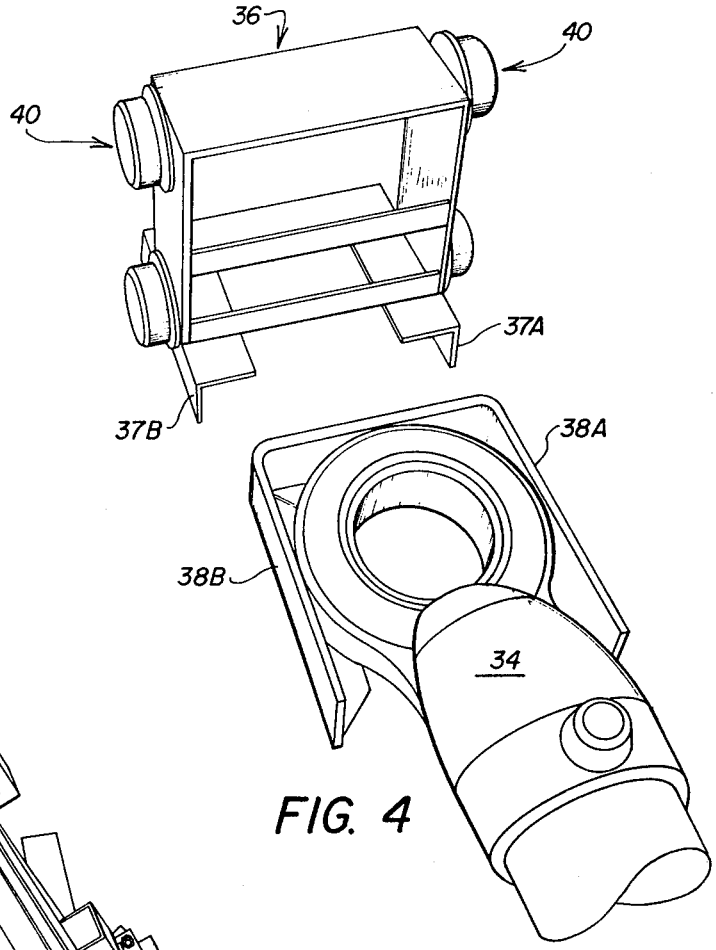
FIG. 4 is a view of a carriage which is mountable in the apparatus for initially receiving torque from the drive unit.

A generally box-like carriage 36 (FIG. 4) is adapted to rest on top of the powered unit 34, but preferably is not connected thereto by means of fasteners or the like. Two depending elements 37A, 37B extend downwardly for an appropriate distance to engage the powered unit 34. A commercially available powered unit is modified by the addition of linear sides 38A, 38B, which are rigidly and permanently secured to the powered unit. The depending walls 37A, 37B are adapted to extend downwardly over the added side walls 38A, 38B. On either side of the carriage 36 are pairs of wheels 40 (or other low-friction elements), which facilitate the vertical translation of the carriage within the upright structure 28. That is, when an anchor is driven into the earth by virtue of the torque imparted by the powered unit, the carriage 36 is captively held within the upright frame 28 and travels downward between the two opposed channels 30, 31. Torque reaction loads from the powered unit 34 are transferred through the carriage 36 to the upright frame 28, and thence to the ground.

Figure 5:
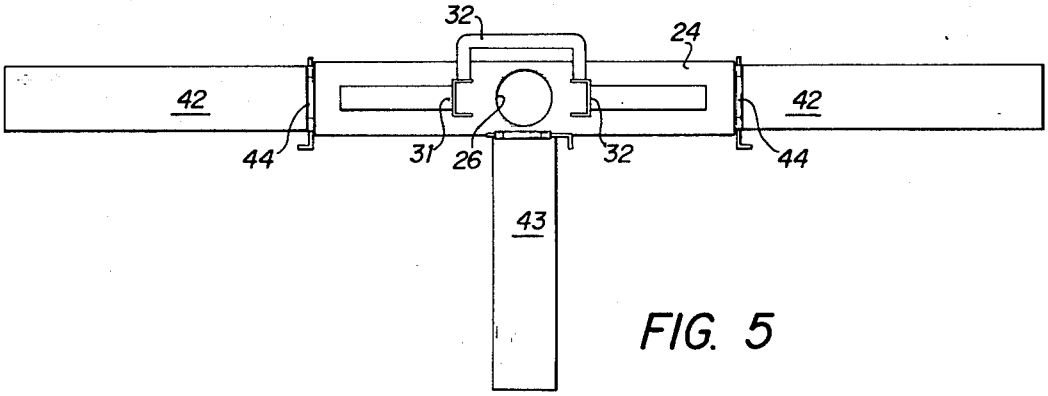
FIG. 5 is a top view of the apparatus shown in FIGS. 2 and 3.

With additional reference to FIG. 5, a set of three ground-contacting outriggers 42, 43 are provided for extension from the base 24 in three radial directions from the upright frame 28. The purpose of the outriggers 42, 43 is to improve the transfer of torque imposed on the frame to the ground, by distributing reaction loads over a wider area. Since two such outriggers 42 at opposite ends of the base 24 will accommodate most loads, only two such groundcontacting outriggers might be deemed to be necessary. As a contingency for those soils in which inserting an achor is particularly difficult, the third outrigger 43 is optionally available. Since the outriggers 42, 43 may not always be needed, it is preferred that they be pivotally attached to the sides of the base with hinges 44, such that they may be rotated upward to a stored position alongside the upright frame 28 when they are not in use. The hinge pins (and outriggers) can also be removed so that the total weight of the device 20 can be minimized at desired times, such as when the device is being loaded or unloaded on a truck. By providing the capability of at least partially disassembling and thereby lightening the device 20, one man can readily transport the device and move it around at a job site...even though the total device may be made of steel which is heavy enough and strong enough to permit drilling through most any soil. In one respect, it is the ability to convert what has traditionally been a long and tedious two-man job into a simplified and relatively quick one-man operation that most clearly characterizes the device 20.

To further improve the efficiency of the outriggers 42, 43 it is preferred that they have at least one protrusion 46 which is adapted to be manually forced into the ground in order to inhibit rotation of the base as a result of torsional loads created by the driving unit 34. The preferred shape of said protrusion 46 is the form of an elongated blade, with the longitudinal axis of each blade extending parallel to the longitudinal axis of its associated outrigger.

Figure 6:
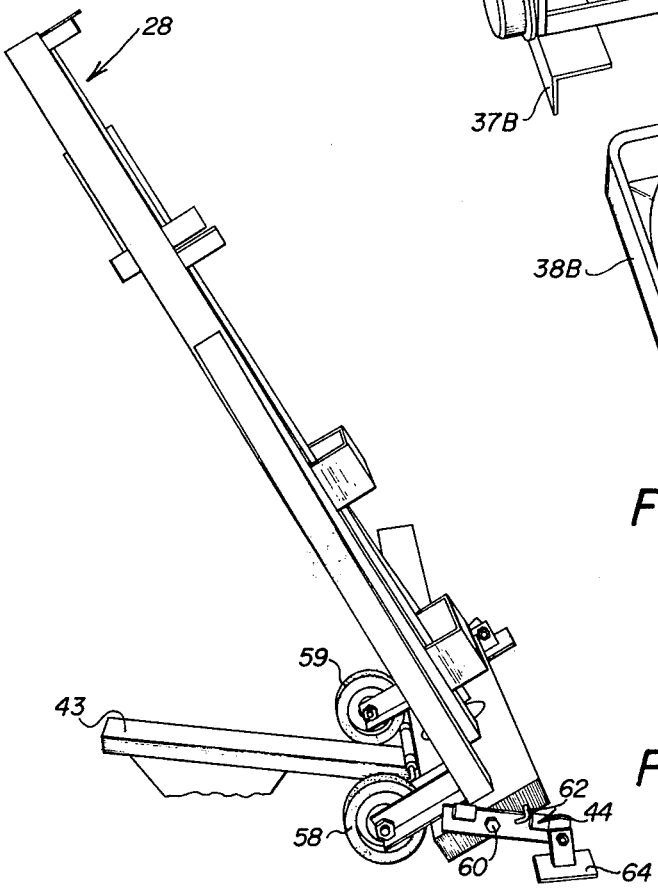
FIG. 6 is a side elevation view of the mobile apparatus shown in FIG. 2.
Figure 10:
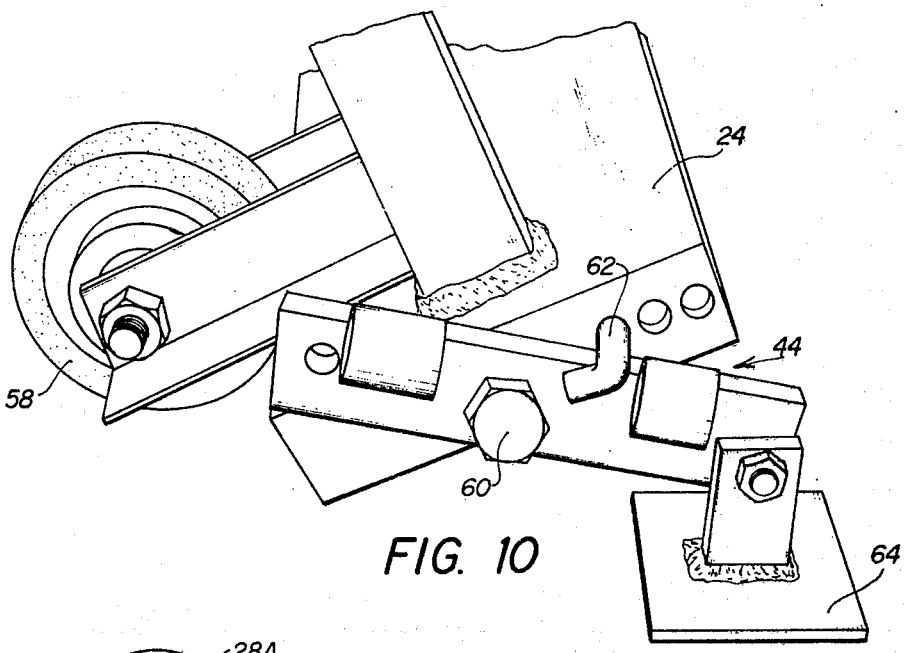
FIG. 10 is an enlarged view of the base showing how it can be mechanically inclined with respect to the earth's surface.

Referring next to FIG. 6, there is provided at the base 24 a means for mechanically tilting the base with respect to the earth, whereby an anchor may be driven into the ground at a direction other than perpendicular to the ground. The tilting means includes at least one adjustable leg, which ideally is combined with the hinge 44 by mounting said hinge with a single bolt 50 through the ends of the base 24. A locking pin 62 is selectively placed in any of several holes in the end of base 24, so as to provide the desired inclination of the upright frame 28 with respect to horizontal ground. It will be seen that permitting upright frame 28 to lean away from a perpendicular can cause the hinge 44 to rotate about bolt 60, while foot 64 (which is pivotally connected to one end of hinge 44) will continually bear against the ground. If the bolt 60 is inserted through a hole in base 24 which is relatively near the back edge of the base, then hinge 44 will remain essentially horizontal even though the upright frame 28 is tilted away from the vertical. Keeping in mind, though, that the hinge 44 (and bolt 60) constitute the mechanical connection through which torque is transferred between the outrigger 42 and the base 24, it is generally preferable to have the bolt 60 mounted in a hole near the center of hinge 44. The slight inclination of outrigger 42 due to tilting upright member 28 backward has not been found to be a problem. An enlarged view of one of the hinges 44 (with its pin removed) is shown in FIG. 10, wherein the device 20 is securely held about 30° away from vertical. Also seen in FIG. 10 is one of a pair of wheels 58, 59 which are advantageously used to roll the device 20 along the ground toward the desired installation spot.

Figure 11:
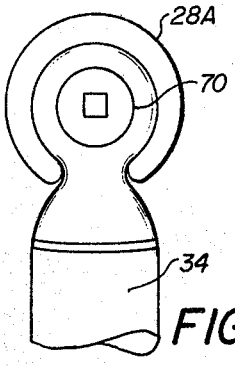
FIG. 11 is a partial view of an alternate embodiment of structure for transferring torque from a drive unit to the ground.

FIG. 11 shows the (partial) top view of another embodiment of an upright frame which is adapted to accommodate the reaction loads that are manifested when an anchor is twisted into the ground. In this embodiment, a heavy steel pipe 28A is longitudinally split along one side to provide a gap which is just wide enough to accommodate the neck or a drive unit 34. Of the two embodiments, the channeled frame 28 and its roller carriage 36 can be expected to exhibit less drag on the unit 34 than the slit pipe 28A; hence, it may well be preferred in many cases. An adapter 70 can also be seen in this figure, with its square aperture for mating with the square top of a mandrel.

In use of the apparatus 20, it is anticipated that an operator will arrive at a work site with the apparatus loaded in the back of a pickup truck or the like. The operator will then remove the apparatus from his vehicle and roll it on its own wheels 58, 59 until he reaches a desired anchoring spot. He will then make a decision as to what length anchor is to be installed, and select an appropriate anchor from his inventory. If the anchor he has selected already has a welded flight attached to its foot, he will then be ready to turn the anchor into the ground. If his anchor bolt does not have a flight, he would first mate such a flight to the anchor bolt. One way of mating the two is shown in FIG. 12, wherein a short tubular piece 80 is securely welded to the bottom surface of the flight 50. An L-shaped foot 56 may be first inserted in the tube 80 and then twisted so that it assumes a position like that shown in FIG. 7; once it begins to turn in the earth, it cannot be separated. He will then insert the anchor bolt (which has no head on it at this time) inside the mandrel 10. Next he would position the combination of a mandrel and an anchor inside the upright frame 28, with the anchor flight extending through the hole 26. If a mobile home is being anchored and the home is already on site, the frame 28 may be tilted back so that the head of the installed anchor may even lie under the edge of the home, where it can later be concealed. He would then place a selected power drive unit on top of the mandrel, and energize the same to provide torque to the mandrel. If the soil is relatively soft, there may be no significant resistance and the power unit will simply screw the anchor into the earth. As sometimes happens, however, the installation process begins with relative ease and then the condition of the soil changes, such that an appreciable increase of torque is required to continue driving the anchor. If the operator can no longer easily hold the drive unit erect, he would stop the unit and reach for the carriage 36 which should be nearby. He would simply lower the carriage through the opening between channels 30, 31 until it came to rest on top of the drive unit. When the drive unit is again activated, the torque reaction loads are transferred to the mobile apparatus 20, rather than being resisted through the strength of a human operator. If the torque reaction loads become so great that the frame begins to tilt, one or more outriggers may be rotated outward to a horizontal position. Stepping on them will drive the blades into the ground, thereby locking the device 20 against rotation with respect to the ground. After the anchor has been driven into the ground such that only a short piece of the anchor bolt extends above the surface, the drive unit is switched off.

The operator would then typically reach for the carriage 36 and lift it vertically out of the upright frame 28, in order to lift its weight off the mandrel. Of course, it would be possible to let the drive unit furnish the power to lift the carriage 36, but manually removing the carriage makes it easier for the drive unit 34 to extracate the mandrel from the earth. Assuming that the flight on the anchor 2 had a right-hand orientation, the anchor (and mandrel) would have been screwed into the ground with clockwise rotation of the drive unit. To remove the mandrel, then, the drive unit would be reversed in its direction to provide counter-clockwise rotation. If an electrical drive unit 34 is employed which has only a single direction of rotation, the drive unit would have to be manually turned over. As the mandrel is rotated counterclockwise, it will be pushed (or lifted) out of substantially the same slit in the earth that was cut during insertion. It will be recalled that the anchor was held to the mandrel only during clockwise rotation, and counter-clockwise rotation of the mandrel will simply leave the anchor behind in the bottom of the hole. After the power unit 34 has lifted the mandrel completely out of the hole, the mandrel and drive unit may be set aside. The apparatus 20 could then be laid on the ground, since the opening 26 provides adequate clearance for that portion of the anchor which may still be protruding above the earth's surface. A head or the like would then be screwed on top of threads provided for that purpose on the top of the anchor 2. The apparatus 20 would then be rolled to another work site, where the process would be repeated.

While only the preferred embodiments of the invention have been disclosed in great detail herein, it will be apparent to those skilled in the art that modifications thereof can be made without departing from the spirit of the invention. Thus, the specific structures shown herein are intended to be exemplary and are not meant to be limiting, except as described in the claims appended hereto.

What is claimed is:

1. The method of securely placing a screw-type anchor in the earth without unduly disturbing the surrounding soil, said anchor having a shank and a flight of given pitch, comprising the steps of:

a. enveloping the anchor's shank in a tubular mandrel, said mandrel having a flight near its bottom end of substantially the same pitch as the anchor's flight, with the mandrel's flight constituting an effective continuation of the anchor's flight;

b. placing the tip of the anchor in contact with the earth and rotating the anchor in a direction to cause its entrance into the earth, with anchor rotation being accomplished by rotating the enveloping mandrel so as to apply torsional loads to the anchor near the anchor's flight; and c. after the anchor has been rotated sufficiently to achieve a desired depth in the earth, rotating the mandrel in the opposite direction to cause it to separate from the anchor and to back out of the earth through substantially the same cut that was made when the anchor was turned into the earth.

2. The method as claimed in claim 1 wherein the leading edge of the mandrel's flight is positioned so as to abut the trailing edge of the anchor's flight, so that rotating the mandrel can impart a torsional load on the anchor through the anchor's flight.

3. The method as claimed in claim 1 wherein torque reaction loads recited in the two rating steps are passed to the earth through a mobile frame.

4. The method as claimed in claim 1 wherein an electrically powered portable torque unit is employed to rotate the mandrel, and the direction of rotation is reversible by manually flipping a switch, whereby the mandrel can be extracated from the earth without physically disconnecting the torque unit from the mandrel.

* * * * *